US005987868A

United States Patent [19]

Weeger et al.

[11] Patent Number: 5,987,868

[45] Date of Patent: Nov. 23, 1999

[54] MONITORING OF CORE MOUNTING FOR A ROVING FRAME

[75] Inventors: Hans-Peter Weeger, Hattenhofen; Dietmar Stähle, Adelberg, both of Germany

[73] Assignee: Zinser Textilmaschinen GmbH, Ebersbach/Fils, Germany

[21] Appl. No.: 09/159,488

[22] Filed: Sep. 23, 1998

[30] Foreign Application Priority Data

Sep. 24, 1997 [DE] Germany ..... 197 42 154

[51] Int. Cl.[6] ..... D01H 9/10

[52] U.S. Cl. ..... 57/281; 57/264; 57/266; 57/267

[58] Field of Search ..... 57/264, 266, 267, 57/281, 90

[56] References Cited

U.S. PATENT DOCUMENTS

| | | | |
|---|---|---|---|
| 4,720,967 | 1/1988 | Guttler | 57/281 |
| 4,841,719 | 6/1989 | Sasaki et al. | 57/281 |
| 5,010,725 | 4/1991 | Yasui et al. | 57/281 |
| 5,148,665 | 9/1992 | Kidani | 57/281 |
| 5,375,405 | 12/1994 | Weeger | 57/281 |
| 5,402,951 | 4/1995 | Hermanns et al. | 57/264 |
| 5,724,801 | 3/1998 | Kogiso et al. | 57/281 |
| 5,768,876 | 6/1998 | Messing | 57/281 |

FOREIGN PATENT DOCUMENTS

| | | |
|---|---|---|
| 38 36 330 | 4/1990 | Germany . |
| 40 37 880 | 6/1992 | Germany . |
| 41 32 243 | 4/1993 | Germany . |
| 42 29 296 | 3/1994 | Germany . |
| 195 05 225 | 8/1996 | Germany . |
| 44 21 778 | 11/1996 | Germany . |
| 93/01336 | 1/1993 | WIPO ..... 57/281 |

*Primary Examiner*—William Stryjewski
*Attorney, Agent, or Firm*—Herbert Dubno

[57] ABSTRACT

A roving frame has a flyer region into which the suspension carriage trains are moved past a device for monitoring the presence or absence of cores or bobbins on the hangers. An error signal is transmitted in the case of an error and correction is effected when the suspension carriage train is in the flyer region. The suspension carriage train is then moved back past the sensors and either on this backward movement or the next forward movement, the functional correctness or poor mounting is again measured. Correction is effected in each case in the flyer region where the hangers are more readily accessible.

13 Claims, 3 Drawing Sheets

MONITORING OF CORE MOUNTING FOR A ROVING FRAME

FIELD OF THE INVENTION

Our present invention relates to roving frames and, more particularly, to suspension carriage systems for roving frames. Specifically the invention relates to a method of and an apparatus for monitoring the attachment of cores and bobbins on the carriages or hangers of suspension carriage trains used to convey full bobbins from and empty core sleeves to a flyer region of a roving frame.

BACKGROUND OF THE INVENTION

A roving frame can comprise a flyer region having at least one and usually two or more rows of flyers, each of which is associated with a spinning spindle at which a core or core sleeve can be disposed so that in the roving process, the yarn can be wound upon the core sleeves to form a full bobbin thereon.

Although not relevant to the present invention, the roving frame may be provided with a drafting frame fed with sliver from a can field and the system can be equipped with one or more spinning frames (especially ring spinning frames) a creel in which empty core sleeves can be stationed until they are transferred to the flyer region and into which the bobbins can be fed in a waiting position, and a track system connecting the waiting position, creel, flyer frames and spinning frames.

The full roving bobbins are thus delivered to ring spinning or other machines for the further steps in the production of yarn or thread.

The roving frame can be associated with a suspension carriage system including tracks or rails running from the waiting location into the flyer region and leading out of the flyer region to a waiting region or creel and then to the other machines with which the flyer frame may be associated. That track system, for example, can service a number of roving frames and a number of spinning machines. The empty core sleeves, hereinafter referred to simply as cores, and the full bobbins can be displaced on suspension carriage trains which can have a number of mutually-articulated supports or holders from which the empty cores or the cores fully wound with yarn (full bobbins) can be suspended. Such "carriages" can be articulated together to provide a train which can extend the full length of the row of flyers and can be referred to as a suspension carriage train. The "carriages" may have grippers at the respective holders which automatically engage the cores when the latter are thrust from below onto the holders and can automatically release the cores as part of a bobbin change process.

In a standard bobbin change process, for example, in a system in which the suspension carriage train is fed into the flyer region of the roving frame, the spindle rail can rise to transfer fully wound bobbins to the suspension carriage train, the suspension carriage train can advance to position empty core sleeves in line with the spindle and the spindle rail can rise again to capture the empty core sleeve from the suspension carriage train.

The suspension carriage train, which thus brought empty cores into the flyer region, can then leave with the fully wound bobbins. At a replacement station, the fully wound bobbins may be removed from the suspension carriage train and replaced by empty cores. There may be a station at which yarn residues may be removed from the empty cores.

Such systems are known and, since automatic operation of bobbin-change systems do depend upon having empty cores correctly mounted with the suspension carriage train at the appropriate location, no fully or partially wound cores on that train at the time it enters the flyer regions, and no omissions of such cores at positions of the suspension carriage trains which are supposed to have such cores, monitoring of the suspension carriage system for functional correctness of core and bobbin mounting is essential.

The flyer frame and suspension carriage train system has been described, inter alia, in U.S. Pat. No. 5,375,405 which corresponds to German patent document DE 42 29 296 A1.

The invention is particularly concerned with such monitoring and its starting point is a roving frame with a system for automatic replacement of full roving bobbins with cores (empty core sleeves) in an arrangement in which the full bobbins and the cores are carried by a suspension carriage train on a track or rail system through the flyers (see also German patent document DE 44 21 778 C2). The monitoring for functionally correct core and bobbin mounting here is intended to establish that the hangers of the train have properly received the full bobbins or are carrying the empty core sleeves or have transferred them before or after the bobbin change operation. The type of mounting can be determined and it is also possible with this system to recognize whether the mounted element is a core or a bobbin. Upon a failure, i.e. a deviation from the prescribed mounting, an error signal is generated.

While this system provides a basis for monitoring the correctness of the adjustment of cores or bobbins to the hangers, it cannot itself assure that prior to the initiation of the bobbin replacement operation, every full bobbin can be transferred to the correct hanger and every spindle will receive a core. Hence there have remained problems with respect to correction of errors which may be detected in even the earlier system.

OBJECTS OF THE INVENTION

It is, therefore, the principal object of the present invention to provide a method of and an apparatus for facilitating the elimination of the deviations or errors signaled by the error signal and thereby assuring that the bobbin replacement can proceed without problems.

It is a more specific object of the invention to provide an improved method of controlling a suspension carriage system for a roving frame, whereby the aforementioned drawbacks can be avoided.

It is also an object of the invention to provide a way of insuring that the bobbin replacement process can proceed in as trouble-free a manner as possible.

SUMMARY OF THE INVENTION

These objects are achieved in accordance with the invention by a system in which the false mounting, signaled by the generation of the error signal or a number of such false mountings on a suspension carriage train are corrected while the suspension carriage train is in the flyer region and upon such correction, the suspension carriage train is displaced back onto the track from which it was fed into the flyer region, past the monitoring sensors at least until the last false mounting position has been brought back past the sensors, whereupon the suspension carriage train is fed anew into the flyer region in conjunction with a new mounting operation which again will generate an error signal if a false mounting is discovered. This may be repeated as is necessary to completely eliminate all false mounting and only when no further error signal is acknowledged and generated, is the bobbin replacement operation effected with the suspension carriage train fully in the flyer region.

The method of the invention can thus comprise the steps of:

(a) at least at one location along the track during movement of the suspension carriage train into the flyer region monitoring functionally correct core and bobbin mounting on the carriages thereof and generating at least one error signal representing a core-mounting failure in a case of an improperly missing core on a carriage, an improperly present core carrying all or part of a bobbin on a carriage and a core improperly mounted on a carriage;

(b) correcting the core-mounting failure in the flyer region;

(c) after correction of the core-mounting failure backing the suspension carriage train out of the flyer region onto the track and past the location until all carriages of the train at which failures were detected are moved upstream of the location;

(d) subsequently displacing the suspension carriage train from the track into the flyer region; and (e) during the backing of the suspension carriage train out of the flyer region onto the track or subsequent displacing of the suspension carriage train from the track into the flyer region, again monitoring functionally correct core and bobbin mounting on the carriages thereof and generating at least one error signal representing a core-mounting failure.

The apparatus can comprise:

monitoring means at least at one location along the track and effective during movement of the suspension carriage train into the flyer region for monitoring functionally correct core and bobbin mounting on the carriages thereof and generating at least one error signal representing a core-mounting failure in a case of an improperly missing core on a carriage, an improperly present core carrying all or part of a bobbin on a carriage and a core improperly mounted on a carriage, the core-mounting failure being corrected in the flyer region;

means for backing the suspension carriage train out of the flyer region onto the track and past the location until all carriages of the train at which failures were detected are moved upstream of the location after correction of the core-mounting failure;

means for subsequently displacing the suspension carriage train from the track into the flyer region, during the backing of the suspension carriage train out of the flyer region onto the track or subsequent displacing of the suspension carriage train from the track into the flyer region, the monitoring means again monitoring functionally correct core and bobbin mounting on the carriages thereof; and control means for blocking the bobbin change operation as long as the error signal is generated.

The suspension carriage train can be displaced from the creel of a ring-spinning machine or from a waiting region at the rear part of the roving frame into the flyer regions in the front part of the roving frame past the sensor location in which the mounting status is automatically detected. At this station, a missing core, a falsely mounted core or a full bobbin on the suspension carriage train can be recognized and an error signal generated which can alert the service person. Upon the generation of the error signal and to ensure that it will be effectively responded to, the error signal can automatically block further operating steps including replacement of full bobbins with empty cores.

In the flyer region, a false mounting at a particular position of the suspension carriage train can be corrected most simply since there the hangers are most readily accessible. For example, a missing core can be readily attached, and a core in the wrong position can be rehung or removed, or a bobbin carrying turns of yarn can be removed and, if necessary, replaced by an empty core. The false mounting can be acknowledged to the service terminal of the system, whereupon the carriage can be free to back out of the flyer region, an operation which can be triggered by hand or can be automatically effected when the last false mounting has been corrected.

The suspension carriage train is then backed out of the flyer region sufficiently so that the false mounting position of the train most foremost in its advance into the flyer region is brought back past the monitoring unit. This can, of course, be ensured by backing the suspension carriage train entirely past the monitoring unit and out of the flyer region. However, it is also possible to store in memory the false mounting positions along the train and thus to enable backing of the train only until the leading one of these positions, based upon the memory or storage, is brought back past the monitoring unit. This latter approach shortens the path over which the suspension carriage train must be moved backwardly and thereby increases the speed of the process.

During the backing operation or in the next advance of the suspension carriage train, the monitoring system is again activated so that the suspension carriage train is once again monitored for false core or bobbin mounting. This can be repeated as often as necessary to the point that no further mounting error is detected or until the monitoring unit is cut out.

Once the removal of the defects is acknowledged and no further error removal is required, and no other error is detected on further advance into the flyer region, the bobbin change can be automatically effected.

The monitoring station can have three sensors, namely, a position sensor, a core sensor and a bobbin sensor. Using the position sensor, the core sensor and optionally the bobbin sensor can be activated in each of the monitored positions and hence a failure with respect to the core (missing or misplaced core) or a failure with respect to the bobbin (bobbin present inappropriately) can be ascertained for each of the hanger positions of the suspension carriage train and the error signal generated and, if desired, the position from which that error signal was generated, being recorded.

The sensors can be mechanical, optical or magnito-inductive, the core and bobbin sensors are preferably of the optical type with the core sensor being, for example, of the broken light beam kind. The bobbin sensor may be a light detector which responds to the light transmitted with a certain window, aperture or width.

The monitoring unit can further include a controller which is connected to the sensors and can have means for generating an error signal which can be recognized by an operator or which is used to control the suspension carriage system, e.g. by being connected to the drives for the suspension carriages and for the roving frame, and particularly with the bobbin-change mechanism. Advantageously, the control means includes a memory which can store the positions at which errors on the suspension train have been detected.

The position sensor can operate by means of switching tabs which are assigned to the positions of the hangers or carriages and are activated by the latter and signal the positions at which the core sensor at least can respond.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
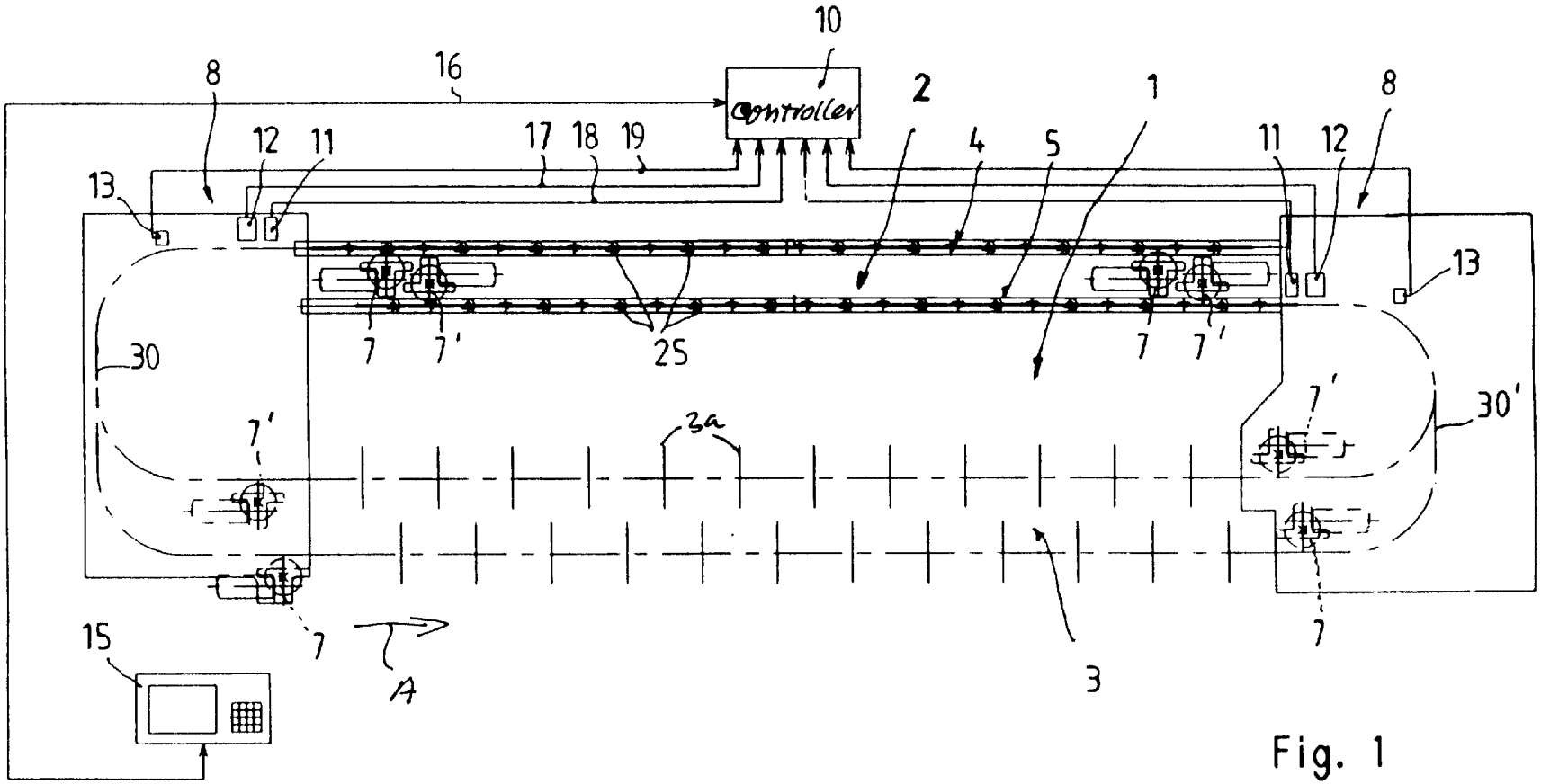
FIG. 1 is a schematic top plan view of a roving frame with waiting tracks for the suspension carriage trains.
Figure 2:
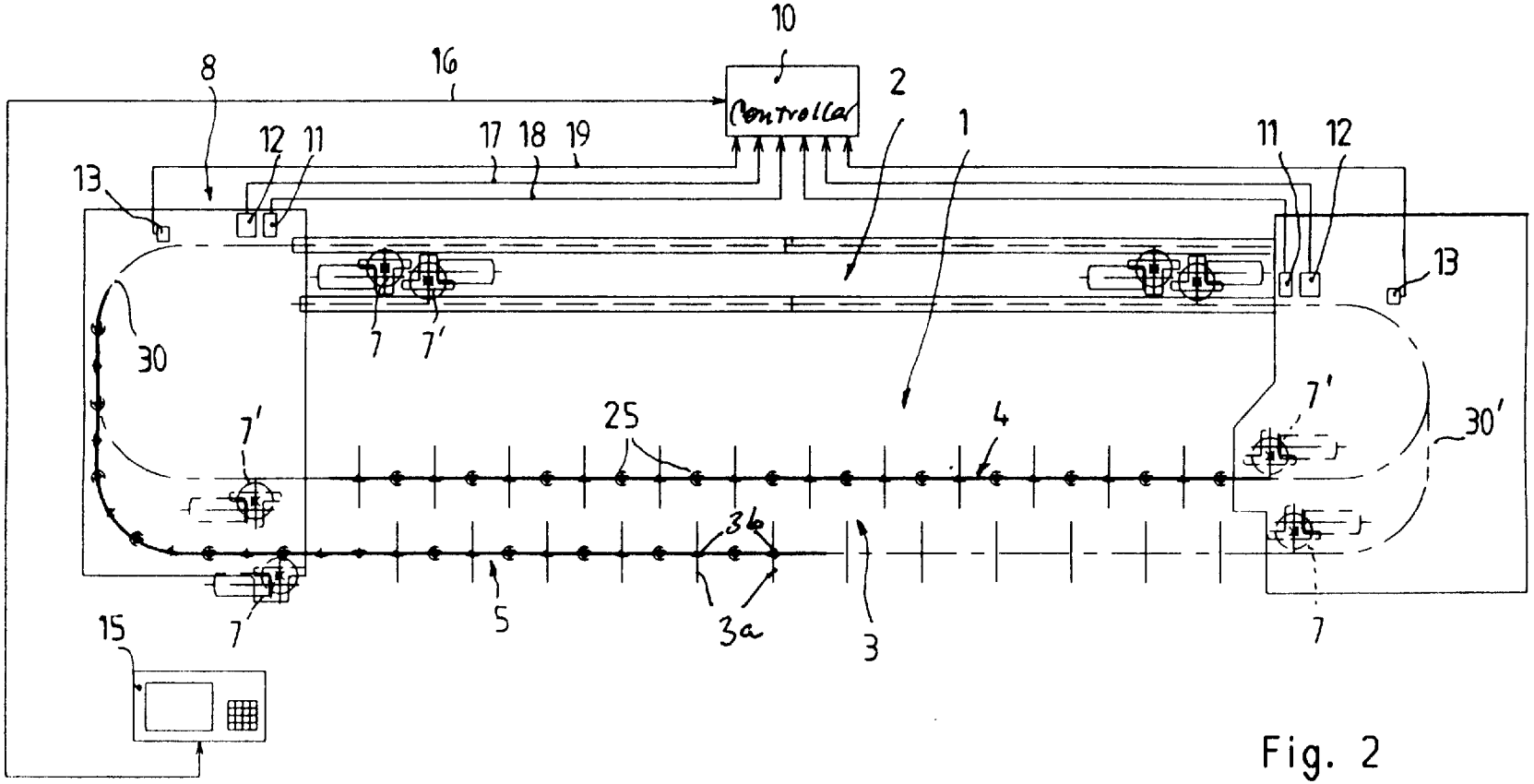
FIG. 2 is a view similar to FIG. 1 in which one suspension carriage train is shown to have been fed partly into the flyer region for error detection while another suspension carriage train has been fully fed into the flyer region for the bobbin change step.

FIGS. 1 and 2 are schematic plan views of a roving frame 1 which has a waiting region 2 and a flyer region 3. Two rows of flyers 3*a* are provided in the flyer region and spindles 3*b* can be aligned with them. To enable the suspension carriage trains to be passed through the flyer region, the flyers 3*a* can be arranged transversely to the suspension train path (arrow A). The flyers are set in rotation only after the suspension carriage train has left the flyer region and the cores have been deposited upon the spindles.

In the embodiment of FIGS. 1 and 2, two suspension carriage trains 4, 5 with hangers 25 are provided in the waiting region 2 on parallel tracks. These two suspension carriage trains 4 and 5 can be driven by drives 7 and 7' shown diagrammatically in the drawing over tracks 30 and 30' into the respective flyer rows. For the flyer region 3 further drives 7 or 7' can be provided to displace the suspension carriage trains 4 or 5.

Between the waiting regions 2 and the flyer region 3, each of the tracks 30 or 30' has a monitoring device 8 which is suitable for detecting the failures in mounting of cores with the hangers. Each monitoring device 8 can include a position sensor 11, a core sensor 12 and a full bobbin sensor 13. The position sensor 11 is connected by a line 18 and a control unit 10 while the core sensor 12 is connected thereto via a line 17 while the bobbin sensor 13 is connected to the controller 10 by a line 19.

The control unit 10 is connected by a line 16 with a service terminal 15. While in the position shown in FIG. 1, the two suspension carriage trains 4 and 5 are in the waiting region 2, in the position shown in FIG. 2, the suspension carriage train 4 is shown to have been already fully inserted into the flyer region 3 while the suspension carriage train 5 is only partly inserted into the flyer region 3 and is in a position which enables removal of mounting errors.

When the suspension carriage train 5 is displaced into the flyer region 3 from the waiting region 2, it passes the monitoring unit 8 which detects defects in the mounting of cores on the train. A missing core, a core placed on the wrong hanger or a core which still contains a quantity of yarn are all detected.

Correction is carried out in the flyer region and cores can be added to the hangers where they have been improperly omitted, removed from the hangers on which they have been wrongly mounted and full bobbins or partially full bobbins can be removed or replaced as is necessary. The detection can result in a generation of an error signal as noted, and when the system no longer recognizes that errors exist, the roving frame can be set again in operation, e.g. for the bobbin replacement. The process is repeated with backing of the suspension carriage train out of the flyer region whenever correction has been completed so that the suspension carriage train can then pass the sensors again and further signals generated if necessary. The process can be repeated until there are no longer any mounting failures at which time the bobbin change can occur. The error correction is carried out and acknowledged while the suspension carriage train 4 or 5 is at standstill in the flyer region.

When this cure of the mismounting is acknowledged and there remains a mismounted location, that will be detected in the next pass of the monitoring unit 8.

Figure 3:
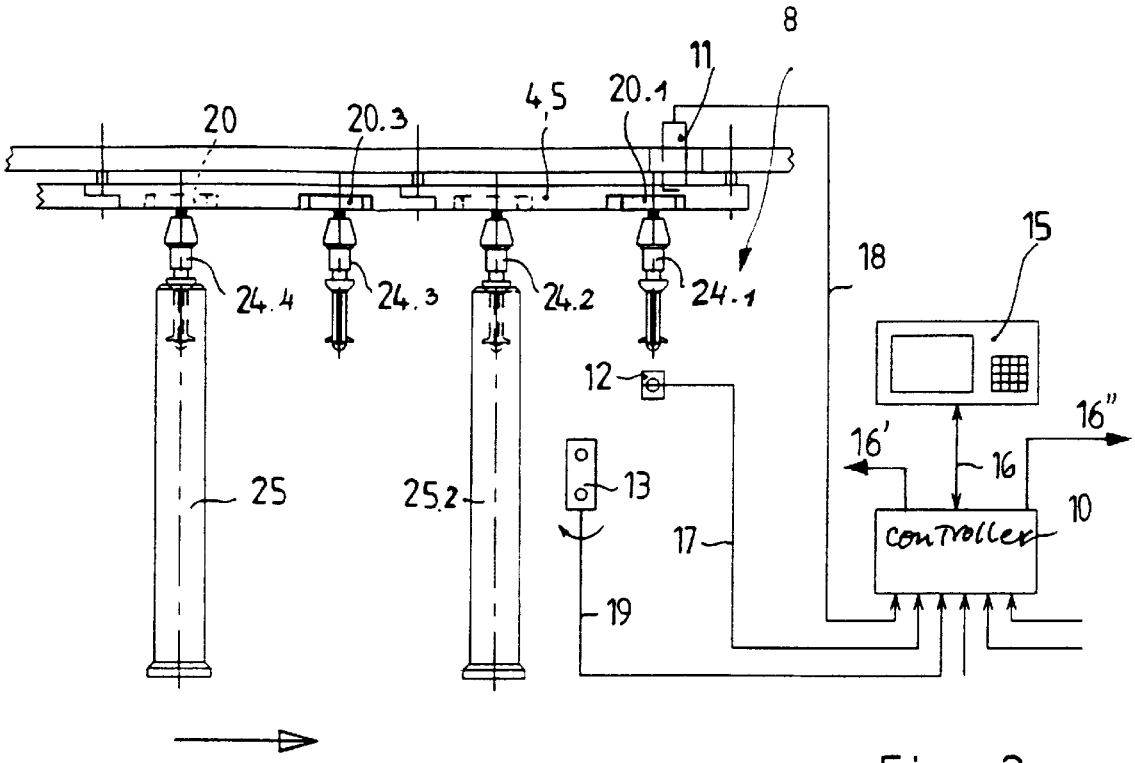
FIG. 3 is a side view of the suspension system in the region of monitoring of the mounting of the cores.
Figure 4A:
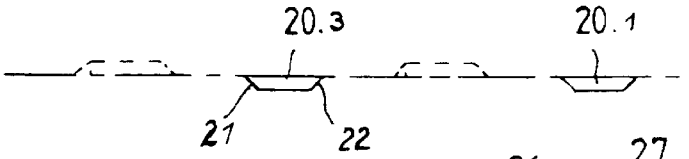
FIG. 4*a* is a plan view of the switching tabs on the suspension carriage train.
Figure 4B:
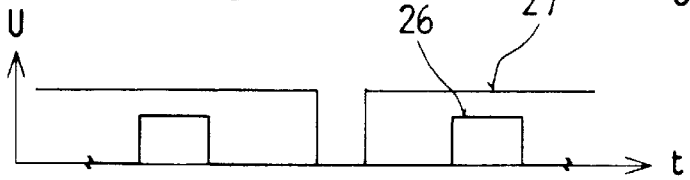
FIG. 4*b* is a voltage-time diagram relating to excitation of the position sensor and the core sensor.

As can be seen from FIG. 3, the position sensor 11 is activated by switch tabs 20.1, 20.3, etc. based upon the positions of the hangers 24.1, 24.2 . . . FIG. 4*a* shows a plan view of the switching tabs of the suspension carriage train. The broken line showing of the tabs represents tabs which are effective upon the reversal in the travel of the suspension carriage train. The switching is so effected that the sensor 11 is triggered by engagement with the leading edge of each switching tab 20.1 etc. in accordance with line 26 in the timing diagram of FIG. 4*b*. The core sensor 12 is either blocked by a core or is unblocked in the absence of a core, i.e. the light beam is not interrupted in the absence of a core and in the case that a core is expected, an error signal will be generated. The triggering of the position sensor 12 by the next switching tap 20.3 can detect when a core is to be absent or present and, in the case of an error, again generate an error signal. When both switching tabs 20.1 and 20.3 signal positions at which cores are detected, i.e. a core has been wrongfully placed on one of the hangers, then the error signal is again generated for that position. The sensing of both position and presence or absence of course can be effected in other ways as well.

The bobbin sensor 13 can be provided to respond to the width of a light beam so that it can indicate whether a core has yarn on it or not. The core sensor need not be activated position by position, but can serve to signal the presence of a core carrying yarn at any point along the length of the suspension train. In that case an error signal can also be generated and the full or partially full bobbin removed when the suspension train is in the flyer region.

FIG. 3 also indicates that a service terminal 15 can be used to provide an input to the controller 10 and to indicate that errors have been removed at all locations. The control unit 10 can thus receive an input from the terminal 15 and provide an input to it. The apparatus can automatically block at least the bobbin change drive until there is acknowledgment at the terminal of elimination of all mounting errors.

The system of the invention operates with high reliability, especially since mismounting are acknowledged and only after such acknowledgment is the error signal terminated and the roving frame operation restored. Such acknowledgement should be given preferably while the suspension carriage train 4 or 5 is still in the flyer region and at standstill. The invention has been found to be highly effective for monitoring mounting of cores on hangers of a roving frame and because correction of the mismatched is effected in the flyer region, the system takes advantage of the high accessibility of service personnel to the suspension chain in this region. The result is improved productivity and a greater degree of automatization of the apparatus.

We claim:

1. A method of controlling a suspension carriage system of a roving frame in which a suspension carriage train for receiving full bobbins on respective carriages is displaced along a track into a flyer region of said roving frame with bobbin cores on carriages of said train to be transferred to respective spindles of the roving frame, comprising the steps of:

(a) at least at one location along said track during movement of said suspension carriage train into said flyer region monitoring functionally correct core and bobbin mounting on the carriages thereof and generating at least one error signal representing a core-mounting failure in a case of an improperly missing core on a carriage, an improperly present core carrying all or part of a bobbin on a carriage and a core improperly mounted on a carriage;

(b) correcting said core-mounting failure in said flyer region;

(c) after correction of said core-mounting failure backing said suspension carriage train out of said flyer region onto said track and past said location until all carriages of said train at which failures were detected are moved upstream of said location;

(d) subsequently displacing said suspension carriage train from said track into said flyer region; and (e) during said backing of said suspension carriage train out of said flyer region onto said track or subsequent displacing of said suspension carriage train from said track into said flyer region, again monitoring functionally correct core and bobbin mounting on the carriages thereof and generating at least one error signal representing a core-mounting failure.

2. The method defined in claim 1 wherein correction of a core-mounting failure in said flyer region is acknowledged, and the acknowledgment of the correction of the core-mounting failure removes said error signal and frees said suspension carriage train to back out of said flyer region onto said track and past said location.

3. The method defined in claim 1 wherein the backing of said suspension carriage train out of said flyer region onto said track and past said location and the subsequent displacing of said suspension carriage train from said track into said flyer region with monitoring of the functionally correct core and bobbin mounting on the carriages thereof are effected automatically.

4. The method defined in claim 1 wherein the backing of said suspension carriage train out of said flyer region onto said track and past said location and the subsequent displacing of said suspension carriage train from said track into said flyer region with monitoring of the functionally correct core and bobbin mounting on the carriages thereof are repeated until core mounting on the carriages of the suspension carriage train is error free.

5. The method defined in claim 1, further comprising the step of effecting a bobbin change operation in said flyer region to transfer cores to said spindles from said carriages and full bobbins from said spindles to said carriages when the core mounting on the carriages of the suspension carriage train is error free.

6. A suspension carriage system for a roving frame in which a suspension carriage train for receiving full bobbins on respective carriages is displaced along a track into a flyer region of said roving frame with bobbin cores on carriages of said train to be transferred to respective spindles of the roving frame in a bobbing change operation in which cores on said suspension carriage train are transferred to spindles of the flyer region and bobbins at said spindles are transferred to said suspension carriage train, said system comprising:

monitoring means at least at one location along said track and effective during movement of said suspension carriage train into said flyer region for monitoring functionally correct core and bobbin mounting on the carriages thereof and generating at least one error signal representing a core-mounting failure in a case of an improperly missing core on a carriage, an improperly present core carrying all or part of a bobbin on a carriage and a core improperly mounted on a carriage, said core-mounting failure being corrected in said flyer region;

means for backing said suspension carriage train out of said flyer region onto said track and past said location until all carriages of said train at which failures were detected are moved upstream of said location after correction of said core-mounting failure;

means for subsequently displacing said suspension carriage train from said track into said flyer region, during said backing of said suspension carriage train out of said flyer region onto said track or subsequent displacing of said suspension carriage train from said track into said flyer region, said monitoring means again monitoring functionally correct core and bobbin mounting on the carriages thereof; and control means for blocking said bobbin change operation as long as said error signal is generated.

7. The system defined in claim 6 wherein said control means acknowledges corrections of the core-mounting failures and after correction of the last core-mounting failure permits said suspension carriage train to pass into said flyer region and unblocks said bobbin change operation.

8. The system defined in claim 6 wherein said control means has storage for a suspension carriage of said train at which there is a core-mounting failure and controls said means for backing so that said suspension carriage train is backed past said location until the suspension carriage of said train at which there is a core-mounting failure is disposed at said location.

9. The system defined in claim 6 wherein said monitoring means includes a position sensor responsive to travel of carriages of said train past said position sensor, a core sensor and a bobbin sensor.

10. The system defined in claim 9 wherein said position sensor is responsive to distributed elements on said train.

11. The system defined in claim 10 wherein said distributed elements are switching tabs spaced along said train.

12. The system defined in claim 11 wherein said bobbin sensor is a light detector with an effective window of a width corresponding to the width of windings on a bobbin.

13. The system defined in claim 6 wherein said flyer region has two rows of flyers and at both ends of said flyer region there is a respective monitoring means for each track connected to said rows for respective suspension carriage trains.

* * * * *